US007639147B2

(12) United States Patent
Berezowski et al.

(10) Patent No.: US 7,639,147 B2
(45) Date of Patent: Dec. 29, 2009

(54) SYSTEM AND METHOD OF ACOUSTIC DETECTION AND LOCATION OF AUDIBLE ALARM DEVICES

(75) Inventors: Andrew G. Berezowski, Wallingford, CT (US); Walter L. Heimerdinger, Minneapolis, MN (US); Charles R. Obranovich, Blaine, MN (US); John A. Phelps, Minneapolis, MN (US); D. Michael Shields, St. Paul, MN (US); Philip J. Zumsteg, Shorewood, MN (US)

(73) Assignee: Honeywell International Inc., Morristown, NJ (US)

( * ) Notice: Subject to any disclaimer, the term of this patent is extended or adjusted under 35 U.S.C. 154(b) by 587 days.

(21) Appl. No.: 11/322,020

(22) Filed: Dec. 29, 2005

(65) Prior Publication Data

US 2007/0152809 A1 Jul. 5, 2007

(51) Int. Cl.
*G08B 23/00* (2006.01)

(52) U.S. Cl. ..... 340/573.1; 340/531; 340/384.4; 340/286.05

(58) Field of Classification Search ..... 340/531, 340/540, 332, 573.1, 566, 565, 815.65, 815.4, 340/815.46, 384.4, 286.05, 331, 328, 521, 340/522, 500; 381/56, 58, 110; 704/246; 367/198, 199

See application file for complete search history.

(56) References Cited

U.S. PATENT DOCUMENTS

| | | | | |
|---|---|---|---|---|
| 4,473,821 | A | 9/1984 | Yang et al. | |
| 4,617,555 | A * | 10/1986 | Sheiman | 340/531 |
| 5,710,555 | A * | 1/1998 | McConnell et al. | 340/916 |
| 6,268,798 | B1 | 7/2001 | Dymek et al. | |
| 6,686,839 | B2 * | 2/2004 | Chou et al. | 340/540 |
| 6,978,159 | B2 * | 12/2005 | Feng et al. | 455/570 |
| 2002/0145521 | A1 | 10/2002 | Chou et al. | |

OTHER PUBLICATIONS

Extended European Search Report corresponding to European Patent Application No. 06256308.5, dated Sep. 19, 2007.

* cited by examiner

*Primary Examiner*—Anh V La
(74) *Attorney, Agent, or Firm*—Husch Blackwell Sanders Welsh & Katz

(57) ABSTRACT

A system and method to detect PASS-type device audio alarm signals and to locate such devices in alarm in a public building, airport, sports stadium or other structure which can include a system to measure speech intelligibility. Time and frequency domain analysis are carried out to establish the pressure of PASS-type device audio output signals.

20 Claims, 4 Drawing Sheets

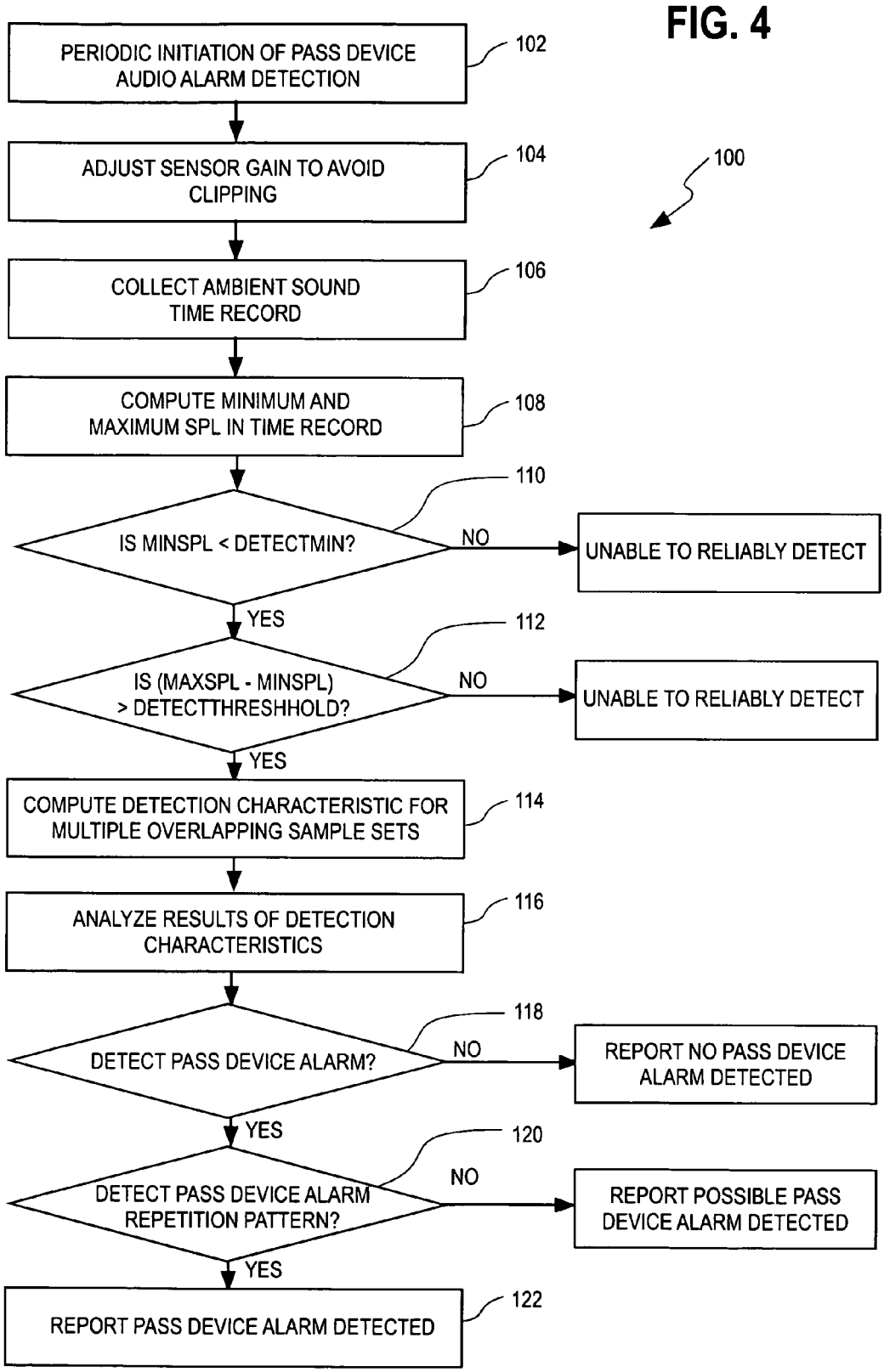
FIG. 4
100
PERIODIC INITIATION OF PASS DEVICE AUDIO ALARM DETECTION
102
ADJUST SENSOR GAIN TO AVOID CLIPPING
104
COLLECT AMBIENT SOUND TIME RECORD
106
COMPUTE MINIMUM AND MAXIMUM SPL IN TIME RECORD
108
IS MINSPL < DETECTMIN?
110
NO
UNABLE TO RELIABLY DETECT
YES
IS (MAXSPL - MINSPL) > DETECTTHRESHHOLD?
112
NO
UNABLE TO RELIABLY DETECT
YES
COMPUTE DETECTION CHARACTERISTIC FOR MULTIPLE OVERLAPPING SAMPLE SETS
114
ANALYZE RESULTS OF DETECTION CHARACTERISTICS
116
DETECT PASS DEVICE ALARM?
118
NO
REPORT NO PASS DEVICE ALARM DETECTED
YES
DETECT PASS DEVICE ALARM REPETITION PATTERN?
120
NO
REPORT POSSIBLE PASS DEVICE ALARM DETECTED
YES
REPORT PASS DEVICE ALARM DETECTED
122

SYSTEM AND METHOD OF ACOUSTIC DETECTION AND LOCATION OF AUDIBLE ALARM DEVICES

FIELD OF THE INVENTION

The invention pertains to systems and methods of detecting audio output alarm signals from Personal Alert Safety System (PASS) devices typically worn by first responders at an emergency scene. More particularly, systems and methods in accordance with the invention distinguish such audio alarm signals from other sounds, and identify the location of the respective audio alarm in a particular region such as public buildings, airports, sports stadiums and the like.

BACKGROUND OF THE INVENTION

Personal Alert Safety System (PASS) devices date back to the 1980's (i.e. NFPA 1982 was developed from the Technical Committee on Protective Equipment at a meeting in 1980), and PASS-type products from many vendors have been introduced over the intervening years.

PASS devices are usually worn by first responders, firemen for example, to provide a level of personal protection for such individuals in very dangerous circumstances. They usually emit an audio alarm if the wearer falls, ceases moving or the like. The intent is to identify acoustically the location of an individual that is in trouble and needs assistance. They can also emit pre-alarm and informational signals.

One common requirement for PASS devices is environmental robustness, including operation after 2 hour immersion in water (NFPA 1982-1998 Edition, "Standard on Personal Alert Safety Systems (PASS)", Section 6-4), and high temperature operation up to +203 deg. F. after a 15 minute exposure (Section 6-12.11). One method of implementing an audio sounder for this harsh environment is to use a piezo-diaphram module.

Exemplary devices that are of a type used by first responders include:

DSX-II (2004)
MSA AirPack Integrated (1996)
MSA FireFly II (1993)
SurPass 88 (1988)
LifeGard II (1985)
PAL5 (1982)

Market research indicates (circa-2004) that there have been about 15 PASS device vendors in the USA, and several more internationally, with a total of over 50 PASS device products. Observing that half of the test device vendors are no longer producing PASS devices, it is estimated that over 100 different PASS device products have been placed in service since 1982.

It has been recognized that PASS device audio output alarm signals are not always heard by other first responders at an emergency scene. This of course can be due to noise at the scene from a variety of sources as well as chaotic conditions often present in emergencies.

Adding to the challenge of successful PASS device detection are the acoustic conditions present at an emergency scene. The PASS device audio alarm signal sound pressure level (SPL) at 1 m. is defined to be 100 dBA for pre-alarm signals and 95 dBA for alarm signals (NFPA 1982-1982 Edition, Section 5-1.1 and 5-1.2). With fireground SPL exceeding 105 dBA, the PASS device pre-alarm signal is at −5 dB relative to the ambient SPL (i.e. caused by the fire).

Further, civilian testing indicates that the PASS device alarm signal SPL may be attenuated by 20 dB or more when the PASS device is under the body of the wearer (i.e. who is laying on the ground). In this situation, the PASS device audio alarm SPL is diminished to 75 dbA (pre-alarm diminished to 80 dB), some 30 dB (25 dB for pre-alarm) below the ambient fireground SPL. Effectively, the detection mechanism must be sensitive enough to identify the PASS device audio alarm signal having a −30 dB Signal-to-Noise Ratio (SNR) at a 1 meter distance between the PASS device and sensor.

Assuming a 9 foot ceiling (about 3 meters), and the SPL falls with the inverse square of the distance, an un-attenuated (by a body) PASS device audio alarm signal directly under a ceiling-mounted sensor would present a maximum SPL of (95 dbA−9.5 dB)=83.5 dBA. Applying body-caused attenuation (20 dB), the SPL at the sensor would be just 63.5 dBA, or nearly 40 dB below the fireground ambient SPL of 105 dbA.

Based on studies conducted of firefighter fatalities ("Firefighter Fatalities in the United States in 2003", United States Department of Homeland Security, Federal Emergency Management Agency, U.S. Fire Administration, Aug. 2004), fatalities involving PASS device audio alarm signals occurred away from the flamefront, hence the assumed maximum SPL in the building region where detection occurs would be somewhat less than 105 dBA, and the detection SNR would therefore be greater than −40 dB.

Finally, the detection mechanism must function properly over a range of signal repetition and frequency patterns (NFPA 1982-1998 Edition, Appendix A5-2.1), while rejecting other signals having similar component frequencies and repetition rates (i.e. human speech, music, equipment noise, water and fire sounds, etc.).

There continues to be a need for systems and methods which can automatically determine the existence and location of audible outputs from PASS-type devices. Preferably such systems and methods could be integrated with new and into existing building or regional monitoring systems without requiring extensive redesign or additional hardware. It would also be desirable to be able to provide audible and/or visual indicators at monitoring system control panels so that those directing the response to the emergency will immediately be informed that one or more individuals at the scene need immediate assistance.

BRIEF DESCRIPTION OF THE DRAWINGS

FIG. 4 is a flow diagram illustrating exemplary signal processing in accordance with the invention;

DETAILED DESCRIPTION OF THE EMBODIMENTS

Figure 1:
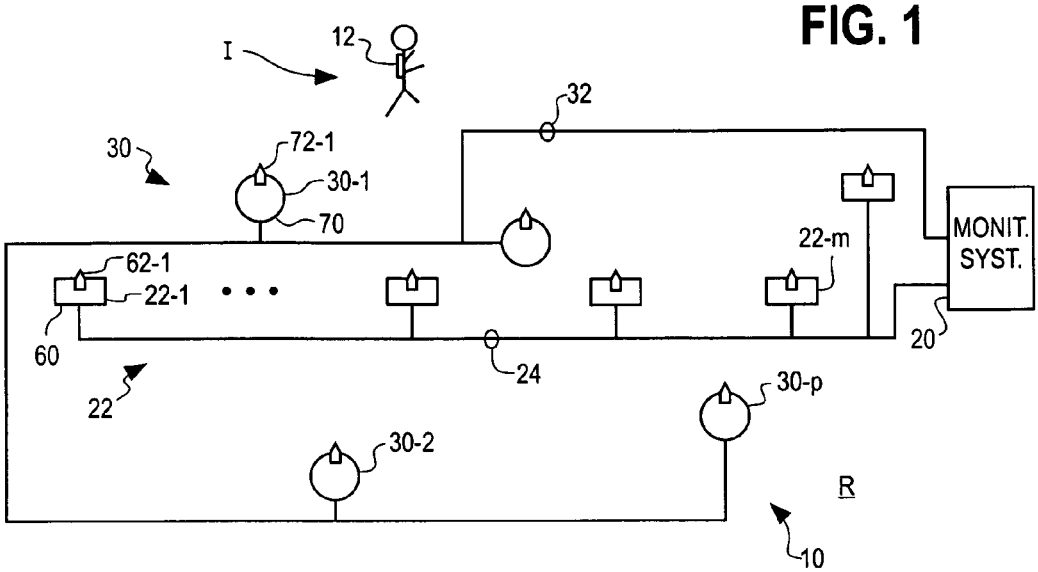
FIG. 1 is a block diagram of a system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

In many locations, such as public buildings, airports, sports stadiums and the like, a system which is present to measure speech intelligibility from audio announcement systems may also incorporate capabilities in accordance with the present invention, to detect and locate PASS device audible alarms. Representative systems include those disclosed in U.S. patent application Ser. No. 10/740,200 filed Dec. 18, 2003 and entitled Intelligibility Testing for Monitoring or Public address Systems as well as U.S. patent application Ser. No. 11/064,414 filed Feb. 23, 2005 and entitled, Methods and Systems for Intelligibility Measurement of Audio Announcement Systems. The two noted patent applications are assigned to the assignee hereof and incorporated by reference. Such considerations apply to audio announcement systems in general as well as those which are associated with fire safety, building or regional monitoring systems.

Systems and methods in accordance with the invention sense and evaluate audio outputs from one or more transducers, such as PASS devices, to detect certain acoustic properties of the PASS device being monitored. The results of the analysis can be used to distinguish PASS device audio alarm signals from other acoustic elements in the region, thereby providing indicators of the presence of a PASS-type alarm as well as location of the PASS device sounding the alarm.

Analysis of audio alarm signal data collected from six PASS devices, manufactured in the period 1982-2004, and the alarm frequencies described in NPFA 1982-1998 Edition, Section 5-2, resulted in the identification of a common signal characteristic unique to the tested PASS devices. The fundamental frequency range and repetition rate of PASSS device alarm signals are specified in NFPA 1982, Section 5-2 and Appendix A-5-2.1. All of the tested products implement the audio transducer in a similar manner, leading to the common signal characteristic which can be used to detect PASS device audio alarm signals.

Exemplary devices tested include:

DSX-II (2004)

MSA AirPack Integrated (1996)

MSA FireFly II (1993)

SurPass 88 (1988)

LifeGard II (1985)

PAL5 (1982)

Since audio outputs of 100% of the tested units have been-accurately detected, due to the common audio transducer design, it is expected that alarms emitted by most PASS-type devices should be properly detectable. In an aspect of the invention, time-domain and frequency-domain signal analysis can be use to detect PASS-type audible outputs.

FIG. 1 illustrates a regional monitoring system 10 which embodies the present invention. At least portions of the system 10 are located within a region R. Speech intelligibility can but need not be evaluated. It will be understood that the region R could be a portion of or the entirety of a floor of a building. The type of building and/or size of the region or space R are not limitations of the present invention.

A first responder I is illustrated in region R. Individual I is wearing one of the known PASS-type devices 12. Neither the exact type of device 12 nor the way in which the individual I carries or wears it are limitations of the invention. If individual I falls or ceases to move, the device 12 will emit its warning signals, as discussed above.

The system 10 includes a monitoring system control unit 20. It will be understood that the control unit 20 could be part of or incorporate a regional control and monitoring system which might include a fire detection system, a security system, and/or a building control system, all without limitation. It will be understood that the details of the unit 20 are not limitations of the present invention.

System 10 can incorporate a plurality of audio sensing modules having members 22-1 . . . **22-*m*. The audio sensing modules or units 22-1 . . . -m can also be in bi-directional communication via a wired or wireless medium 24 with the unit 20**.

As described above and in more detail subsequently, the audio sensing modules **22-*i* respond to incoming audio from one or more PASS-type devices such as the unit 12 and carry out, at least in part, processing thereof. Those of skill will understand that the below described processing could be completely carried out in some or all of the modules 22-*i*. Alternately, the modules 22-*i* can carry out initial portion of the processing and forward information, via medium 24 to the unit 20** for further processing.

The system 10 can also incorporate a plurality of ambient condition detectors 30. The members of the plurality 30, such as 30-1, -2 . . . -p could be in bi-directional communication via a wired or wireless medium 32 with the unit 20. It will be understood that the members of the plurality 22 and the members of the plurality 30 could communicate on a common medium all without limitation.

Figure 2A:
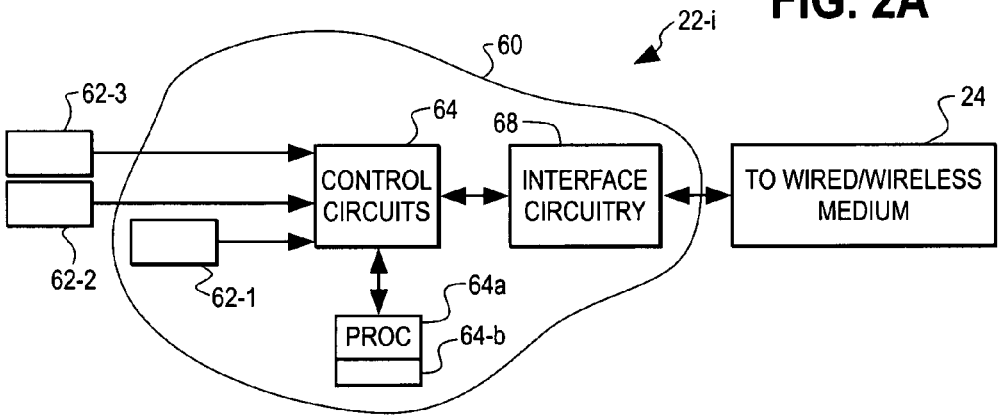
FIG. 2A is a block diagram of an audio sensing module in accordance with the present invention.

FIG. 2A is a block diagram of a representative member **22-*i* of the plurality of audio sensing modules 22. Each of the members of the plurality, such as 22-*i*, includes a housing 60 which carries at least one audio input transducer 62-1 which could be implemented as a microphone. Additional, outboard, audio input transducers 62-2 and 62-3 could be coupled along with the transducer 62-1 to control circuitry 64**.

The control circuitry 64 could include a programmable processor **64*a* and associated control software 64*b*, as discussed below, to implement audio data acquisition processes as well as analysis processes to determine if incoming sensed audio, being received at the transducer 62-1, has been emitted by a PASS-type device, such as device 12. The module 22-*i* can communicate via interface circuitry 68 to the wired or wireless medium 24**.

Figure 2B:
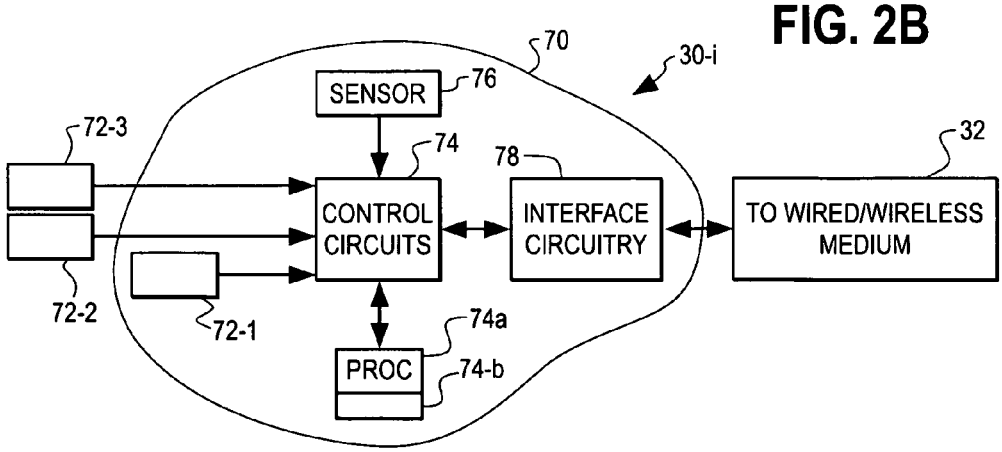
FIG. 2B is a block diagram of an ambient condition detector which incorporates audio sensing in accordance with the present invention.

FIG. 2B is a block diagram of a representative member **30-*i* of the plurality 30. The member 30-*i* has a housing 70 which can carry an onboard audio input transducer 72-1 which could be implemented as a microphone. Additional audio input transducers 72-2 and 72-3 displaced from the housing 70 can be coupled, along with transducer 72-1 to control circuitry 74**.

Control circuitry 74 could be implemented with and include a programmable processor **74*a* and associated control software 74*b*. The detector 30-*i* also incorporates an ambient condition sensor 76 which could sense smoke, flame, temperature, gas all without limitation. The detector 30-*i* is in bidirectional communication with interface circuitry 78 which in turn communicates via wired or wireless medium 32 with monitoring system 20**.

As discussed subsequently, processor **74*a* in combination with associated control software can not only process signals from sensor 76 relative to the respective ambient condition but also audio related signals from one or more transducers 72-1, -2 or -3 all without limitation. Processing, as described subsequently, can carry out evaluation and a determination as to the nature and quality of audio being received and whether that audio is being emitted by a PASS-type device, such as the device 12**.

Figure 3:
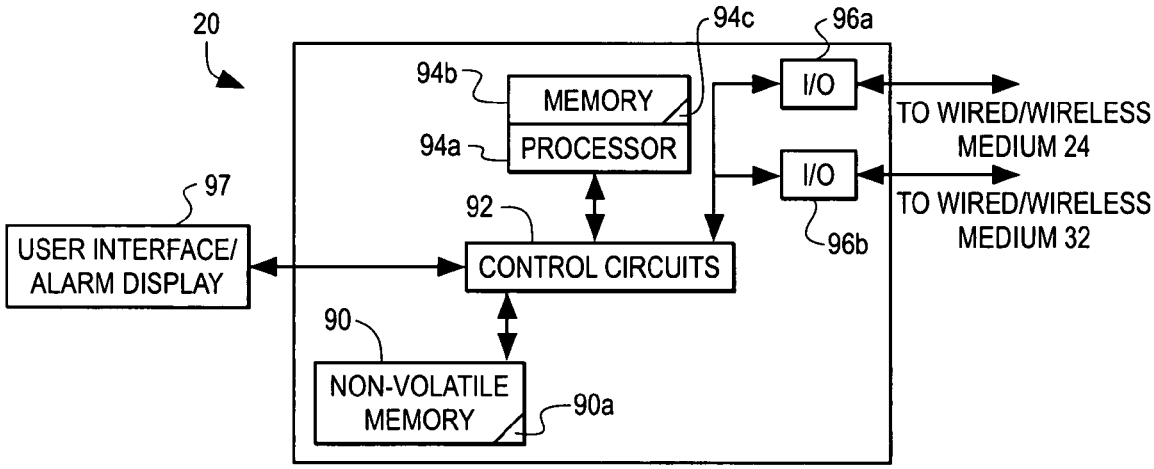
FIG. 3 is a block diagram of a monitoring system control unit.

FIG. 3 is a block diagram of an exemplary representation of the monitoring control unit 20. Unit 20 can incorporate a non-volatile memory or storage unit 90 for purposes of storing control software 90*a*. The unit 20 can also incorporate control circuits 92 coupled to the storage unit 90 and software 90*a*. The control circuits 92 can incorporate a programmable processor 94*a* as well as additional storage 94*b* of a type that would be understood by those of skill in the art which could include read/write memory of a volatile or non-volatile form. Software 90*a*, 94*c* which would be of a type understood by those of skill in the art in responding to audible detection units, such as 22*i*, to carry out intelligibility testing, or, to respond to the detectors, such as the detector 30*i* can be executed by control circuits 92 and/or processor 94*a*.

Unit 20 can incorporate input/output interfaces to mediums 24, 32, namely a circuits 96*a*, 96*b*. In addition, unit 20 can incorporate a user interface and alarm display device 97. It will be understood that the unit 20 illustrated in FIG. 3 is exemplary only is not a limitation of the present invention.

Process 100, see FIG. 4, to establish the presence of one or more PASS-type devices, such as the device 12 in the region R can be executed wholly or in part at audible detection units 22*i*, detectors 30*i* and/or control unit 20. Process 100 can include a periodic initiation thereof, step 102.

In a step 104 the gain of the respective sensor can be adjusted to avoid clipping or distortion. In a step 106 one or more ambient sound time records can be collected. It will be understood that if a plurality of such records are being collected that the subject processing will take place relative to at least selected records.

In a step 108 minimal and maximum sound pressure levels are established for each of the time records. In a step 110 if the minimum sound pressure level is below a predetermined threshold then a determination is made that it is not possible to reliably determine if a PASS-type device is emitting the sensed audible signal based on the subject record.

If the minimum sound pressure level exceeds a predetermined first threshold, a determination is made as to whether or not the difference between a maximum sound pressure level and a minimum sound pressure level exceeds a detection threshold, step 112. If above the detection threshold, in a step 114 a detection characteristic is determined for multiple overlapping sample sets.

The results of the detection step 114 are analyzed, step 116. A determination is made step 118 as to whether a PASS-type device alarm has been detected. If so in a step 120 a determination is made as to whether a repetitive pattern has been determined, and if so, in a step 122 an audible or visible indicator can be presented at user interface 97 indicating that a PASS-type device alarm has been detected and location information can be provided therewith.

It will be understood that the processing 100 of FIG. 4 is illustrative only. Variations thereof come within the spirit and scope of the present invention. Further, those of skill will understand that PASS-type devices whose audio outputs can be recognized as a described above need not conform literally to any predetermined standard.

Figure 5:
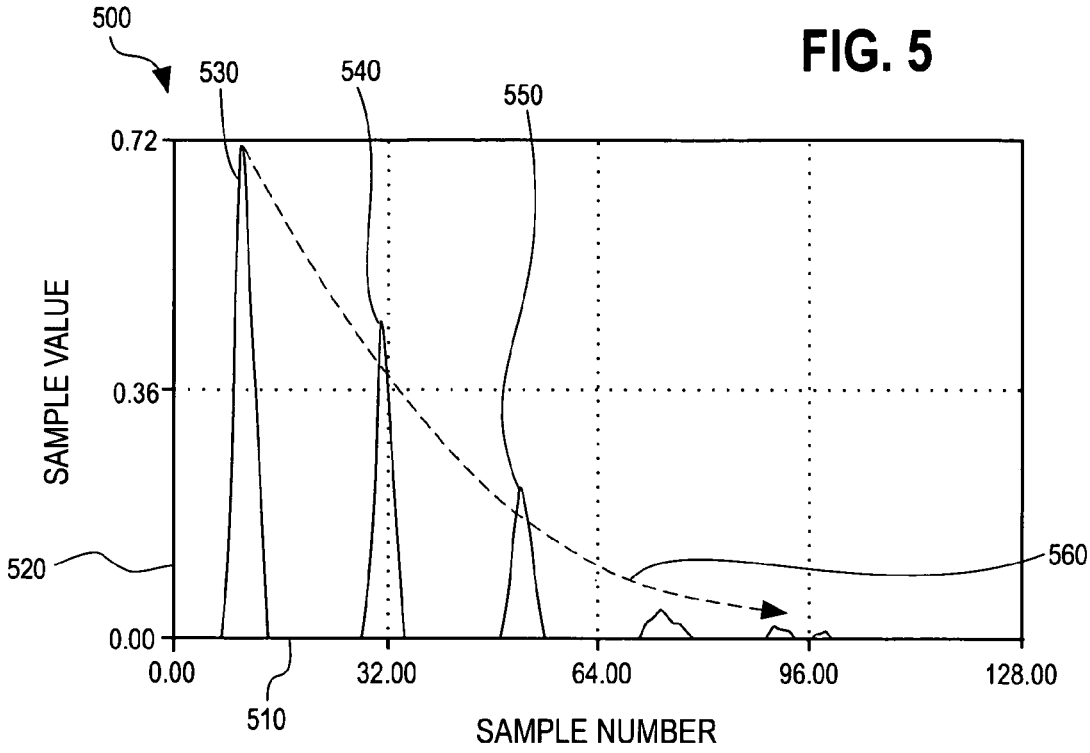
FIG. 5 is a graph illustrating characteristics of the alarm signal.

FIG. 5 further illustrates characteristics 500 of the detected signal (FIG. 4, step 118). In one preferred embodiment, the ambient sound time record is processed with an enhanced summary auto-correlation function (ESACF) producing one or more output values 520 in multiple output bins 510. When at least three output values 530, 540, 550 exhibit a characteristic trend 560 the analysis of detection characteristics (FIG. 4, step 116) is indicated in the affirmative, and subsequent processing occurs (FIG. 4, step 120).

Figure 6:
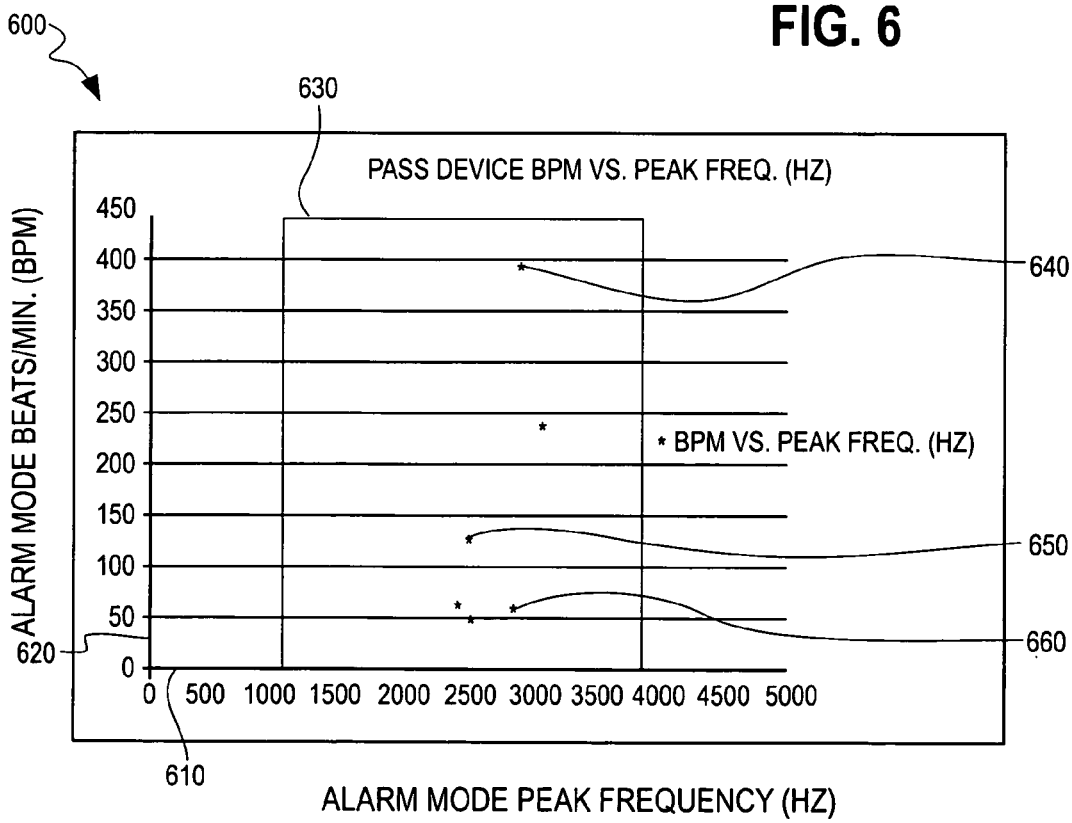
FIG. 6 is a graph illustrating the frequency and beat rate ranges specified by NFPA 1982-1998 and data points measured for the exemplary devices.

FIG. 6 further illustrates the characteristics 600 subject to subsequent processing (FIG. 4, step 120) including the frequency band range 610 and beat rate 620 of the detected signal illustrated in FIG. 5. In accordance with NFPA 1982-1998 a predetermined frequency range and repetition rate are specified for various alarm modes 640. Data points 640, 650, 600 measured from exemplary devices are overlaid with the specified ranges 630.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

collecting a least one ambient sound time based record via a sensor;

evaluating, the sound pressure levels, frequencies and repetition rates of any alarm patterns in the at least one record; and responsive thereto, establishing a detection characteristic for at least the one record; and analyzing the results by comparing the detection characteristic with a predetermined detection characteristic of a Personal Alert Safety System device to determine if the at least one record has been emitted by a predetermined type of electrical unit.

2. A method as in claim 1 where collecting includes collecting a plurality of records.

3. A method as in claim 2 which includes evaluating each member of the plurality.

4. A method as in claim 2 which includes evaluating if a minimum pressure exceeds a predetermined threshold for at least some of the members of the plurality.

5. A method as in claim 2 which includes evaluation if a difference between a maximum pressure and the minimum pressure exceeds a predetermined first threshold for at least some of the members of the plurality.

6. A method as in claim 5 which includes evaluating if a minimum pressure exceeds a predetermined second threshold for at least some of the members of the plurality.

7. A method as in claim 5 which includes establishing a second plurality of the at least some members.

8. A method as in claim 6 which includes establishing a second plurality having members with respective pressure levels above the predetermined threshold.

9. A method as in claim 7 which includes establishing a respective detection characteristic for at least some of the members of the second plurality.

10. A method as in claim 9 which includes, responsive to establishing the respective detection characteristic; determining if at least some members of the second plurality have been emitted by a member of a third plurality of audible output devices.

11. A method comprising:

establishing a first plurality of audible Personal Alert Safety System devices;

collecting at least one record of sounds emitted by an audible output device;

determining if the at least one record has an output parameter that falls within a predetermined range of frequencies and repetition rates of alarm patterns;

responsive to the determining, establishing a plurality of selected characteristics for the at least one record;

determining if the plurality of selected characteristics corresponds to respective characteristic of a member of the first plurality.

12. A method as in claim 11 which includes collecting a plurality of temporally spaced records of sounds emitted by the audible output device.

13. A method as in claim 12 which includes determining which members of the plurality fall within the predetermined range.

14. A method as in claim 13 which includes evaluating those members of the plurality which fall within the predetermined range, and, determining which if any were emitted by a member of the first plurality.

15. A method as in claim 14 which includes generating an indicium indicative of the determined member of the first plurality.

16. A system comprising:

at least one programmable processor;

first software that establishes a first plurality of time based records of received audio;

second software that selects members of the first plurality with sound characteristics that exceed a predetermined sound threshold, contain predetermined frequencies and repetition rates of alarm patterns thereby forming a second plurality; and third software that analyzes the members of the second plurality and which determines those members thereof with sound characteristics that have been emitted by a member of a predetermined group of audible Personal Alert Safety System devices.

17. A system as in claim 16 which includes: fourth software that establishes audible output characteristics of members of the predetermined group.

18. A system as in claim 16 which includes a pre-stored identification of audible output characteristics of the members of the predetermined group.

19. A system as in claim 16 which includes communication software that forwards an identifier of each determined member of the group and the location thereof to a displaced site.

20. A system as in claim 16 including additional software which establishes a location of each determined member of the group.

* * * * *

UNITED STATES PATENT AND TRADEMARK OFFICE

CERTIFICATE OF CORRECTION

PATENT NO. : 7,639,147 B2
APPLICATION NO. : 11/322020
DATED : December 29, 2009
INVENTOR(S) : Berezowski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 719 days.

Signed and Sealed this

Ninth Day of November, 2010

David J. Kappos

David J. Kappos
*Director of the United States Patent and Trademark Office*